US007017287B2

(12) United States Patent
Allen

(10) Patent No.: US 7,017,287 B2
(45) Date of Patent: Mar. 28, 2006

(54) POST SURGICAL FOOT WARMER

(76) Inventor: Farrokh Allen, 502 San Vincente Blvd., San Monica, CA (US) 90402

( * ) Notice: Subject to any disclaimer, the term of this patent is extended or adjusted under 35 U.S.C. 154(b) by 129 days.

(21) Appl. No.: 10/640,450

(22) Filed: Aug. 13, 2003

(65) Prior Publication Data

US 2005/0034331 A1 Feb. 17, 2005

(51) Int. Cl.
*A43B 11/00* (2006.01)

(52) U.S. Cl. ..... 36/110; 36/9 R

(58) Field of Classification Search ..... 36/110, 36/7.1 R, 9 R, 45, 47; 602/27, 65
See application file for complete search history.

(56) References Cited

U.S. PATENT DOCUMENTS 1,502,559 A * 7/1924 Giblin ..... 36/17 A
1,661,726 A * 3/1928 Jensen ..... 36/9 R
2,919,503 A * 1/1960 Sholovitz ..... 36/9 R
3,106,790 A * 10/1963 Zimmon ..... 36/9 R
4,034,431 A * 7/1977 Fukuoka ..... 12/142 MC
4,233,758 A * 11/1980 Auberry ..... 36/3 A
4,486,965 A * 12/1984 Friton ..... 36/50.1
5,699,629 A * 12/1997 Munschy ..... 36/97
6,212,798 B1 * 4/2001 Koenig et al. ..... 36/110
2001/0034956 A1 * 11/2001 Mawusi et al. ..... 36/10

* cited by examiner

*Primary Examiner*—Ted Kavanaugh
(74) *Attorney, Agent, or Firm*—Foley & Lardner

(57) ABSTRACT

A foot warmer designed to keep warm the foot of a patient with a foot injury, a patient recovering from foot surgery, a person with chronically cold feet, or a person who lacks the small motor skills to put on regular shoes. The foot warmer, made from soft, cottony material with a non-slip bottom surface as its sole, has a sole attached to a lower member which attaches to an upper member that covers the in-step. Two flaps attached to the upper member fold over on top of the other side of the upper member and fasten together with long fasteners that give a very wide, gentle degree of comfort and warmth to the foot.

15 Claims, 4 Drawing Sheets

POST SURGICAL FOOT WARMER

FIELD OF THE INVENTION

The present invention relates generally to heat-retaining footwear, and more particularly to heat-retaining slippers designed to be used by patients recovering from foot surgery, persons with chronically cold feet, or persons who lack the small motor skills to put on regular shoes.

BACKGROUND OF THE INVENTION

Foot surgery is often followed by a long, painful recovery period. After foot surgery, such as bunion surgery, hammer-toe correction, reconstruction, etc., the foot is typically extremely sensitive to touch and weight, as well as to cold and heat. Foot surgery often involves the insertion of steel stabilizing pins into the bones of the foot. These pins remain sticking out of the foot during recovery and any movement of them causes extreme pain to the patient. After surgery, the foot is typically encased in a partial cast, with the toes or other portions of the foot exposed.

After foot surgery, the patient is often required to keep the foot elevated during the first stage of recovery. Elevation causes the blood to run away from the foot, and inflammation can cause the flow of blood to the foot to slow down even further, with the result that the exposed portion of the foot gets extremely cold, even in warm weather. During the recovery period, patients often find keeping the affected foot warm very difficult, especially at night. There are no shoes or socks large or flexible enough to fit over the cast and foot without causing pressure to be applied to the painful and sensitive areas.

SUMMARY OF THE INVENTION

Briefly summarized, the present invention, in one embodiment, is a foot warmer adaptable to fit a wide variety of foot sizes as well as an injured or bandaged foot without causing pressure to be applied to the painful and sensitive areas of the foot. The slipper has a sole with a non-slip inferior surface and a shock absorbing superior surface. The sole has an edge that is attached to a lower edge of an upper formed of a soft, lightweight material with insulating properties (such as fleece). The upper has an upper edge shorter than its lower edge. The upper is arranged to wrap gently around the heel toward the instep of the foot, leaving the upper's remaining first and second side edges roughly adjacent the upper front of the instep. A lower flap is attached to a lower portion of the second side edge of the upper. A fastener attached to this lower flap is arranged to adjustably engage a lower fastener adjacent the lower part of the first edge of the upper. An upper flap is attached to an upper portion of the second edge of the upper. A fastener attached to this upper flap is arranged to adjustably engage an upper fastener adjacent the upper portion of the second edge of the upper.

DETAILED DESCRIPTION OF THE INVENTION

Figure 1:
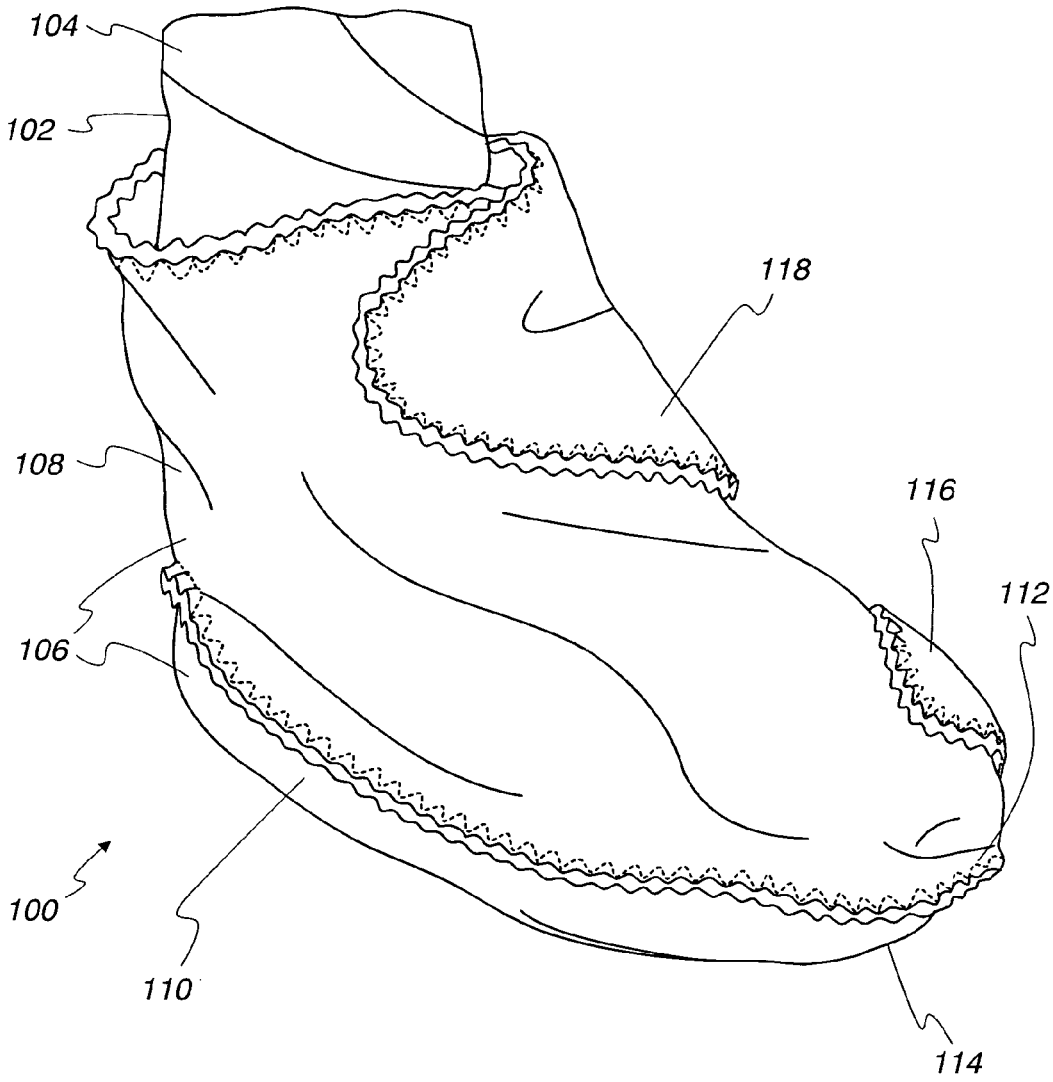
FIG. 1 presents a perspective view of a foot warmer having two flaps attached to an upper member portion of the foot warmer's upper and wrapped about the foot.

With reference to the drawings, FIG. 1 illustrates a slipper designed in accordance with an embodiment of the present invention in position on a leg 102 of one who may, for example, be a surgical patient, or one with a leg irritation or sore, or one who simply wants to keep his or her feet warm or who simply needs slippers.

As can be seen, this embodiment is a foot warmer 100 that is designed to wrap its insulating material around a foot 102. The foot 102 may possibly be bandaged with a bandage 104 that may be quite oddly shaped and bulky, in accordance with the nature of the surgery. Or, in the case of a fracture or sprain, the foot 102 may be wrapped or in a cast, or it may simply be very swollen, and there may be no bandage or cast.

Figure 7:
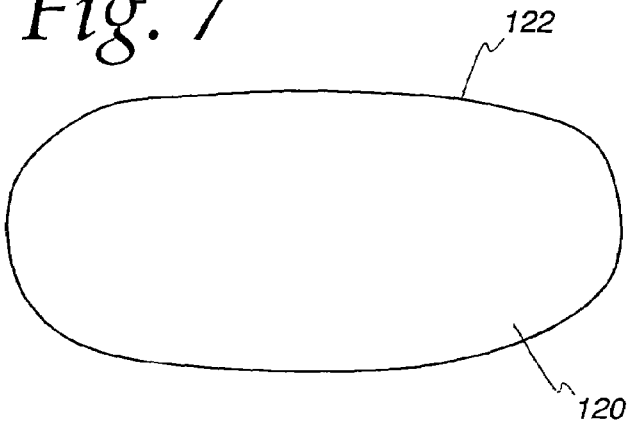
FIG. 7 presents a sewing pattern view of a foot warmer sole 120 having a non-skid inferior surface and a soft superior surface.
Figure 8:
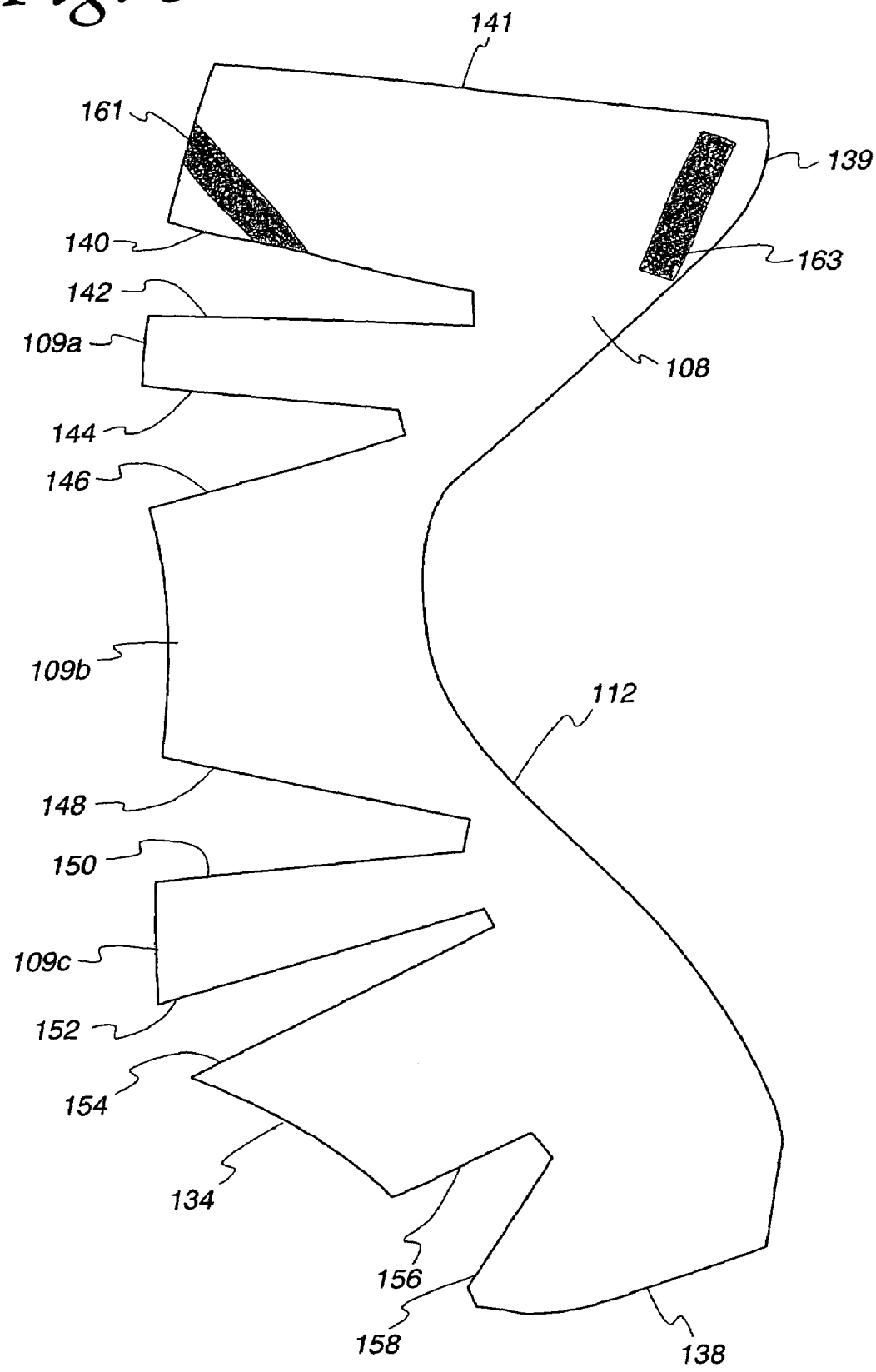
FIG. 8 presents a sewing pattern view of an upper member 108 that forms a foot warmer's upper 106 when the upper member 108's lower edge is joined with the uppermost, long edge of the lower member 110.

As seen in FIG. 1, the foot warmer 100 comprises an upper 106 and a sole 120 (not shown in FIG. 1). The upper 106, as is shown in FIG. 1, is formed from an upper member 108 (FIGS. 1, 2, 3, and 8) and a belt-like lower member 110 (FIGS. 1, 2, 3, and 6). The upper 106 has an inner surface that is constructed of a soft, heat-insulating material such as fleece. The upper member 108 has its lower edge 112 affixed to the lower member's 110 uppermost long edge 114. As can best be seen in FIGS. 6 and 7, a lowermost long edge 124 of the lower member 110 is affixed to a perimeter 122 of the sole 120, which is constructed to have a non-skid inferior surface, possibly formed from a dimpled rubber or a synthetic material. The sole 120 has a superior surface that acts as a shock absorber and that may be formed from soft, cottony flannel material, such as fleece, as is used in constructing the upper 106 such that the perimeter 122 of the sole's inferior non-skid surface and its fleece-like superior surface are affixed to the lowermost long edge 124 of the lower member 110. The narrow ends 126 and 128 of the lower member 110 are sewn together so that the lower member 110 becomes a circular belt connecting the perimeter 112 (FIGS. 1 and 8) of the upper member 108 to the perimeter 122 (FIGS. 2 and 7) of the sole 120. The upper member 108 wraps gently around the back and over the instep 150 of the foot 102 (see FIG. 3). The upper member 108 comprises a medial portion adjacent a first edge 141 and a lateral portion adjacent a second pair of edges 138 and 134, and these portions and edges either overlap or touch or come near together roughly above the instep. Upper fastener 161 and lower fastener 163 lie upon the upper member's 108 medial portion to connect the medial portion and lateral portion when the upper member 108 is wrapped around the foot 102 and any bandages 104.

Figure 6:
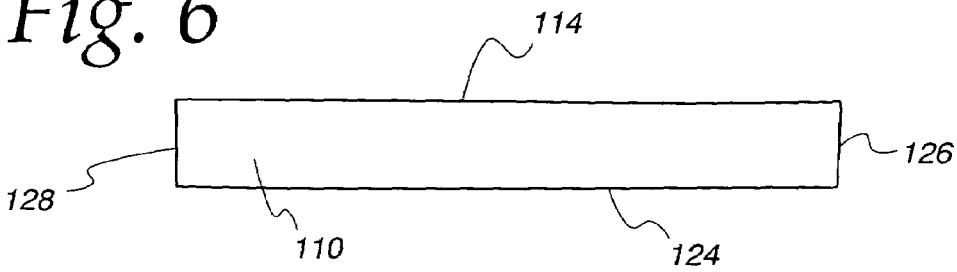
FIG. 6 presents a sewing pattern view of a lower member 110 that forms the lower portion of a foot warmer's upper when it is formed into an oval with its short ends sewn together (foreshortened lengthwise in this view).

In one embodiment, there are upper and lower flaps 116 and 118 (FIGS. 1, 2, 3, 4, and 5), respectively having fasteners 162 and 160, which flaps are attached respectively to the second edges 138 and 134 of the upper member 108. An edge 136 of the lower flap 116 (FIG. 4) is sewn to the edge 138 of the upper member 108 (FIG. 8), while a smaller edge 137 of the flap 116 attaches to the opposite and lower edge 139 of the upper member 108 and also to a corresponding point on the uppermost edge 114 of the lower member 110 (FIG. 6). Accordingly, the lower flap 116 may be wrapped protectively over the lower portion of the foot 102 and the bandage 104 such that its fastener 162 joins with the lower fastener 163 mounted on the upper member 108 in a readily adjustable manner to fit all foot 102 sizes. By way of example, the fasteners may be of the hook and loop type, such as Velcro® brand fasteners.

Figure 3:
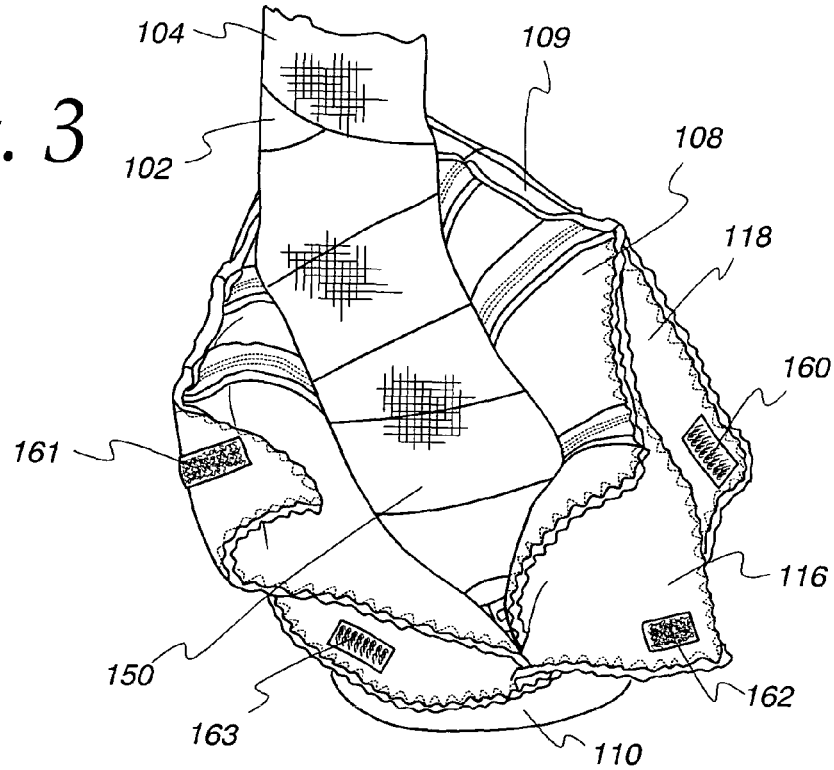
FIG. 3 presents a perspective view of the foot warmer with the foot in place and with the two flaps pulled back and open to reveal their positions relative to the upper member portion of the upper, to reveal how the upper member portion wraps the foot's insole and attaches to the two flaps with the fasteners to give room for adjustment to the size of the foot and the thickness and arrangement of any bandages or cast.
Figure 4:
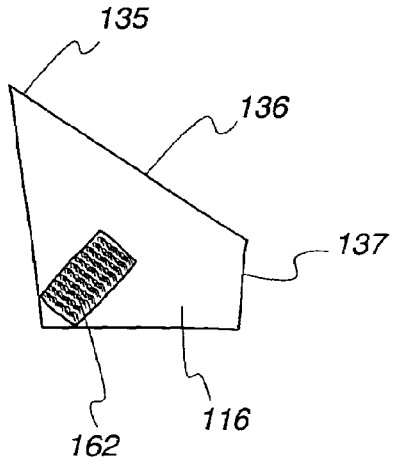
FIG. 4 presents a sewing pattern view of a upper member lower flap 116 having an attachment.
Figure 5:
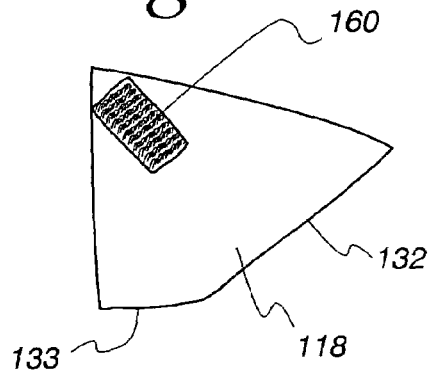
FIG. 5 presents a sewing pattern view of an upper flap 118 having an attachment.

An edge 132 of the upper flap 118 (FIG. 5) is sewn to the edge 134 of the upper member 108 (FIG. 8), while the smaller edge 133 of the flap 118 attaches to the end portion 135 of the edge 136 on the lower flap 116 (FIG. 4). Accordingly, the upper flap 118 may be wrapped protectively over the instep portion 150 (FIG. 3) of the foot 102 and the bandage 104 such that its fastener 160 joins with the upper fastener 161 mounted on the upper member 108 in a readily and widely adjustable manner to fit all sizes, no matter how big the bandage or cast or how bad the swelling of the heel, the instep, or the upper portions of the foot 102. Again, by way of example, the fasteners may be of the hook and loop type, such as Velcro® brand fasteners.

Figure 2:
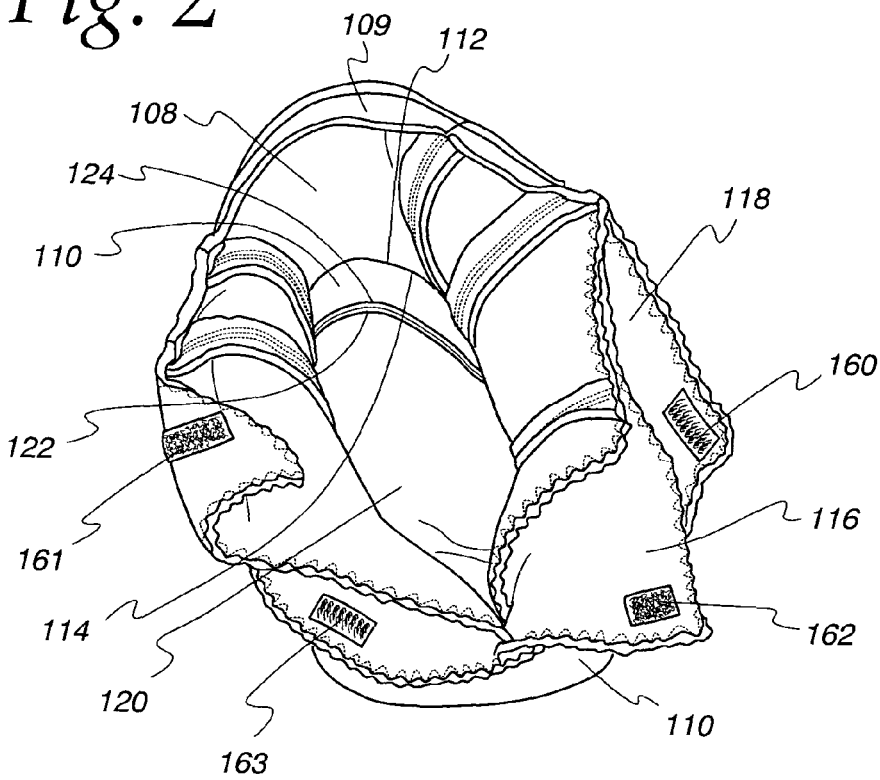
FIG. 2 presents a perspective view of the foot warmer without the foot in place and with the two flaps pulled back and open to reveal their positions relative to the upper member of the upper, their fasteners, the lower member that forms the bottom portion of the upper, and the sole attached to the bottom edge of the lower member.

At the upper edge portion 109 (109 in FIGS. 2 and 3; and, shown unsewn, 109*a*, 109*b*, and 109*c* in FIG. 8) of the upper member 108, and in particular around the heel part of the foot 102 (FIGS. 1 and 3), the material is folded over inside the slipper 100 to form a strong upper edge for the foot warmer 100, as is shown in FIGS. 2 and 3.

Since the portion of the upper member 108's upper edge 109 that surrounds the ankle has a much smaller diameter than the lower edge 112 which is joined to the sole 120 by the lower member 110, notches 140–142, 144–146, 148–150, 152–154, and 156–158 are taken out of the fabric of the upper member 108 and are sewn closed to provide a good fit and taper over the instep.

While the preferred embodiment of the invention has been described, numerous modifications and changes will occur to those who are skilled in the art. Accordingly, it is intended by the claims appended to and forming a part of this application to capture the true spirit and scope of the invention.

I claim:

1. A foot warmer comprising:

a sole having a superior surface, an inferior surface, and an edge;

an upper comprising a lower member having a lower edge affixed to the edge of the sole and having an upper edge, said upper further comprising an upper member having a lower edge affixed to the upper edge of the lower member and also having a medial portion adjacent a first side edge of the upper member and a lateral portion adjacent a second side edge of the upper member, said first and second side edges not being joined together, but said first and second side edges and the adjacent medial and lateral portions being free to overlap, or to come together, or to come near to each other, or to be widely separated, the upper, the sole, and in particular the medial and lateral portions of the upper member thereby being adapted to open widely in essentially all directions to receive a foot lowered substantially vertically onto the sole within the lower member and to cause the upper member to make minimal sliding contact with the foot during the lowering process; and at least one flap attached to at least one of said first and second side edges or the adjoining medial or lateral portions and arranged to adjustably fasten together the medial and lateral portion portions to permit the upper member and the at least one flap to gently wrap around the foot and any swellings, bandages, cast, or pins or other medical condition or treatment that may be associated with the foot without exerting undue pressure on the foot;

whereby the foot is disposed within the volume defined by the upper and the sole with the medial and lateral portions substantially fastened together above the instep of the foot to retain the foot within the foot warmer.

2. The foot warmer of claim 1, wherein the material of the upper is a lightweight insulating material.

3. The foot warmer of claim 2, wherein the lightweight insulating material is fleece.

4. The foot warmer of claim 1, wherein the at least one flap fastens together the medial and lateral portions of the upper member by means of at least one hook and loop fastener connecting the at least one flap to the medial or to the lateral portion or to the adjacent side edge to which portion or edge the at least one flap is not already attached.

5. The foot warmer of claim 1, wherein the at least one flap comprises two flaps.

6. The foot warmer of claim 1, wherein the sole's inferior surface is a non-slip lower surface, and the superior surface is a soft, cottony surface.

7. The foot warmer of claim 6, wherein the non-slip inferior surface, the soft, cottony superior surface, and the lower edge of the upper are all sewn together by a single seam.

8. A foot warmer adaptable to fit a range of foot sizes comprising:

a sole having an inferior surface, a superior surface, and an edge;

an upper having a lower edge attached to the edge of the sole, and arranged to wrap around the heel toward the instep of the foot, with first and second side edges of the upper not being joined together over at least most of their length but being free to overlap, or to come together, or to come nearly together roughly adjacent the front of the instep, or to be widely separated such that the upper is adapted to open widely in essentially all directions to receive a foot lowered substantially vertically onto the sole and to cause the upper to make minimal sliding contact with the foot during the lowering process;

a first flap attached to at least a portion of one of the first and second side edges joining of the upper adjacent that edge's lower edge and having a first fastener attached to said first flap and arranged to adjustably engage a second fastener attached to said upper adjacent the other of said first and second side edges of the upper adjacent that edge's lower edge; and a second flap attached to at least a portion of one of the first and second side edges of the upper adjacent that edge's upper edge and having a third fastener attached to said second flap and arranged to adjustably engage a fourth fastener attached to said upper adjacent the other of said first and second side edges of the upper adjacent that edge's upper edge;

said fasteners providing sufficient range of adjustment as to how far said flaps wrap over said upper so that after a foot is lowered upon the sole, the flaps may be gently pulled past the other of said first and second side edges of said upper around the ankle, the foot, and the instep and also over and around any swellings, bandages, cast, or pins or other medical condition or treatment that may be associated with the foot without exerting undue pressure on the foot.

9. The foot warmer in accordance with claim 8, wherein the upper has an upper edge, and wherein the back portion of this upper edge in the region that is adjacent the back ankle portion of a foot inserted into the foot warmer is folded over upon itself.

10. The foot warmer in accordance with claim 8, wherein the sole has a non-slip inferior surface and a soft, cottony superior surface.

11. The foot warmer in accordance with claim 10, wherein the non-slip inferior surface of the sole, the soft, cottony superior surface of the sole, and the lower edge of the upper are all sewn together by a single seam.

12. The foot warmer in accordance with claim 8, wherein the upper is formed from: a lower member formed of a soft, cottony material having a lower edge attached to the sole and having an upper edge; and an upper member having its lower edge attached to the lower member's upper edge and including all the remaining parts of the upper; and wherein said lower member has side edges that are joined together.

13. The foot warmer in accordance with claim 12, wherein the upper edge of the upper member in the region that is adjacent the back ankle portion of a foot is folded over upon itself.

14. The foot warmer in accordance with claim 12, wherein the sole has a non-slip inferior surface and a soft, cottony superior surface, which two surfaces of the sole and the lower edge of the lower member are all sewn together by a single seam.

15. The foot warmer in accordance with claim 8, wherein the first fastener and the second fastener comprise a hook, and loop fastening system and the third fastener and the fourth fastener also comprise a hook and loop fastening system.

* * * * *